US006186048B1

(12) United States Patent
Kimura et al.

(10) Patent No.: US 6,186,048 B1
(45) Date of Patent: Feb. 13, 2001

(54) VARIABLE DISPLACEMENT COMPRESSOR

(75) Inventors: Kazuya Kimura; Hiroaki Kayukawa; Suguru Hirota; Keiichi Kato, all of Kariya (JP)

(73) Assignee: Kabushiki Kaisha Toyoda Jidoshokki Seisakusho, Kariya (JP)

( * ) Notice: Under 35 U.S.C. 154(b), the term of this patent shall be extended for 0 days.

(21) Appl. No.: 09/226,037

(22) Filed: Jan. 4, 1999

(30) Foreign Application Priority Data

Jan. 13, 1998 (JP) ..... 10-004768

(51) Int. Cl.[7] ..... F01B 3/00
(52) U.S. Cl. ..... 92/71; 91/505
(58) Field of Search ..... 91/505, 506; 92/71, 92/12.2; 74/839; 417/269

(56) References Cited

U.S. PATENT DOCUMENTS 5,057,274 * 10/1991 Futamura et al. ..... 420/534
5,785,503 * 7/1998 Ota et al. ..... 417/269
5,984,643 * 11/1999 Ota et al. ..... 417/269

FOREIGN PATENT DOCUMENTS 8-311634 11/1996 (JP) .
9-60587 3/1997 (JP) .

* cited by examiner

*Primary Examiner*—Edward K. Look
*Assistant Examiner*—Thomas E. Lazo
(74) *Attorney, Agent, or Firm*—Morgan & Finnegan, L.L.P.

(57) ABSTRACT

A variable displacement compressor includes a rotor, which is fixed to a drive shaft, and a pivotal swash plate, which is supported on the drive shaft and slides in an axial direction along the drive shaft. A hinge mechanism is located between the rotor and the swash plate. The hinge mechanism rotates the swash plate integrally with the rotor and guides the pivoting and the sliding motion of the swash plate. The hinge mechanism includes a swing arm, which extends from the swash plate. The swash plate is made of aluminum or aluminum alloy material. The swing arm is separate from the swash plate and is made of iron-based metal material. Therefore, while the swash plate is light, the hinge mechanism is strong.

20 Claims, 5 Drawing Sheets

VARIABLE DISPLACEMENT COMPRESSOR

BACKGROUND OF THE INVENTION

The present invention relates to variable displacement compressors that are used, for example, in vehicle air conditioners.

Examples of the variable displacement compressors are disclosed in Japanese unexamined patent publication No. 8-311634 and No. 9-60587. A housing of the respective variable displacement compressor defines cylinder bores, each of which receives a piston. The housing rotatably supports a drive shaft, and a rotor is fixed to the drive shaft. Furthermore, a pivotal swash plate, which is connected to the piston, engages and is guided by the drive shaft. The swash plate is often made of aluminum or aluminum alloy material to reduce the weight of the compressor. A hinge mechanism connects the rotor to the swash plate. The swash plate is rotated integrally with the drive shaft through the rotor and the hinge mechanism. The hinge mechanism permits pivotal motion and sliding motion of the swash plate.

The hinge mechanism includes a first hinge part, which extends from the swash plate, and a second hinge part, which extends from the rotor. The hinge mechanism further includes a pair of guide pins. A base end of each guide pin is press fitted into a corresponding mounting hole of the first hinge part. A distal end of each guide pin is slidably received in a corresponding guide hole of the second hinge part. When the swash plate is moved in an axial direction of the drive shaft, the distal end of each guide pin slides in the corresponding guide hole to guide the motion of the swash plate.

Rotation of the drive shaft is converted to reciprocation of each piston through the rotor, the hinge mechanism and the swash plate. During the back stroke of the piston, from top dead center to bottom dead center, the refrigerant gas is drawn into the cylinder bore. Then, during the forward stroke of the piston, from bottom dead center to top dead center, the refrigerant gas is compressed in the cylinder bore and, then, is discharged from the cylinder bore. The displacement of the variable displacement compressor can be adjusted by changing the inclination of the swash plate to change the stroke of the piston.

In the prior art, the first hinge part is integrally formed with the swash plate. That is, the first hinge part is also made of aluminum or aluminum alloy material. Therefore, in comparison to first hinge parts that are integrally formed with an iron-based swash plate, an aluminum-based first hinge part is less rigid. As a result, it is difficult to form an aluminum-based first hinge part that has satisfactory strength. Furthermore, it is difficult to press fit the base end of the guide pin into the mounting hole of an aluminum-based first hinge part in a manner that assures satisfactory strength.

Therefore, when an iron-based swash plate is replaced with an aluminum-based swash plate for reducing the weight of the compressor, the strength and durability of the hinge mechanism are reduced.

SUMMARY OF THE INVENTION

The present invention addresses the above disadvantages. It is an objective of the present invention to provide a variable displacement compressor that has a light weight drive plate and a strong hinge mechanism.

Basically, the variable displacement compressor of this invention has a housing, wherein a cylinder bore is formed in the housing, a piston located in the cylinder bore, a drive shaft rotatably supported by the housing, a rotor mounted on the drive shaft to rotate integrally with the drive shaft, a drive plate, and a hinge mechanism. The drive plate is made of aluminum or aluminum alloy material and is connected to the piston to convert rotation of the drive shaft to reciprocation of the piston. The drive plate inclines and slides axially along the drive shaft, which varies the piston stroke to change the displacement of the compressor. The hinge mechanism is located between the rotor and the drive plate for rotating the drive plate integrally with the rotor and for guiding the motion of the drive plate. The hinge mechanism includes a first hinge part, which is made of iron-based metal material and is connected to the drive plate, and a second hinge part, which extends from the rotor. The first and second hinge parts are coupled to one another to permit both pivoting and sliding motion between the first and second hinge parts.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objectives and advantages thereof, may best be understood by reference to the following description of the presently preferred embodiments together with the accompanying drawings in which:

DETAILED DESCRIPTION OF THE PREFERRED EMBODIMENTS

Figure 1:
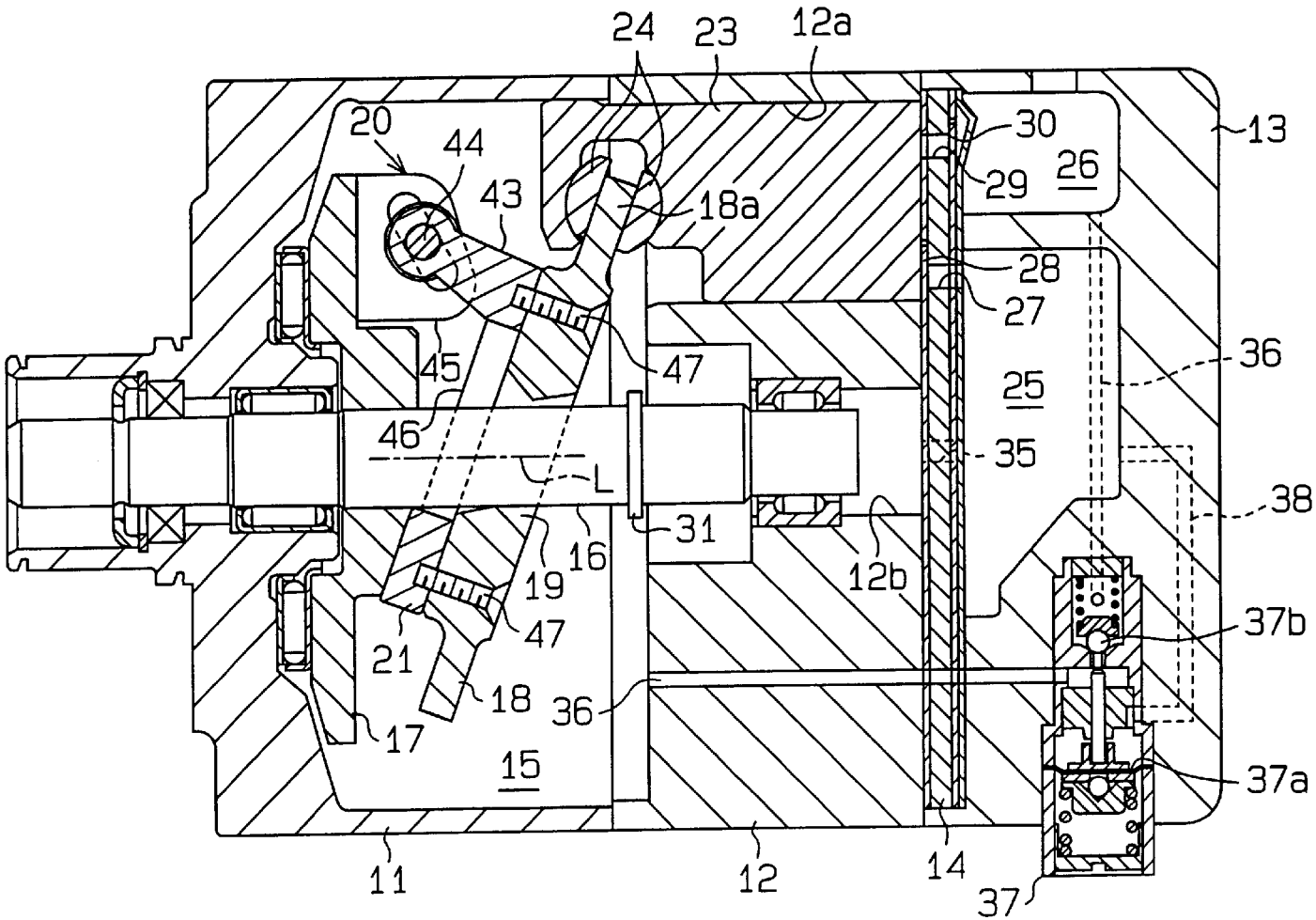
FIG. 1 is a longitudinal cross sectional view of a variable displacement compressor in accordance with a first embodiment of the present invention.

A variable displacement compressor having single-headed pistons according to a first embodiment of the present invention for use in a vehicle air conditioning system will be described with reference to FIGS. 1 to 4. As shown in FIG. 1, a front housing 11 is coupled to the front end of a cylinder block 12, which serves as a center housing. A rear housing 13 is coupled to the rear end of the cylinder block 12, and a valve plate 14 is placed between the cylinder block 12 and the rear housing 13. A crank chamber 15 is defined between the front housing 11 and the cylinder block 12.

A drive shaft 16 extends through the crank chamber 15. The ends of the drive shaft 16 are rotatably supported by the front housing 11 and the cylinder block 12, respectively. The drive shaft 16 is coupled to an external drive source (not shown), or a vehicle engine, by a clutch mechanism such as an electromagnetic clutch. Therefore, by engaging the electromagnetic clutch while the vehicle engine is running, the drive shaft 16 is driven to rotate.

A rotor 17, which functions as a rotary support, is fixed to the drive shaft 16 in the crank chamber 15. Also, in the crank chamber 15, a swash plate 18, which functions as a drive plate, is pivotally supported by a hinge mechanism 20 and can slide along the drive shaft 16. The drive shaft 16 extends through a central through-hole 19 in the swash plate 18. The hinge mechanism 20 is provided between the rotor 17 and the swash plate 18 to rotate the swash plate 18 integrally with the drive shaft 16 and the rotor 17. The hinge mechanism 20 allows the swash plate 18 to incline and slide in the axial direction L of the drive shaft 16.

The process of forming the through-hole 19 will be described with reference to FIG. 2. A circular hole is first drilled in the center of the swash plate 18. Then, a rotating end mill having substantially the same diameter as that of the circular hole is inserted through the circular hole. While the end mill occupies the circular hole, the end mill is pivoted for a predetermined angle about an axis S. The axis S is located opposite to the hinge mechanism 20 with respect to the axis L of the drive shaft 16 and extends in a direction perpendicular to the center axis of the swash plate 18. As a result, as shown in FIG. 2A, an engaging section 19*a*, which forms an arcuate surface about the axis S, is formed at the inner surface of the through-hole 19 on the side that is opposite to the hinge mechanism 20 with respect to the axis L of the drive shaft 16. When the swash plate 18 is installed in the compressor, the engaging section 19*a* always engages the drive shaft 16 during rotation of the swash plate 18.

Figure 4:
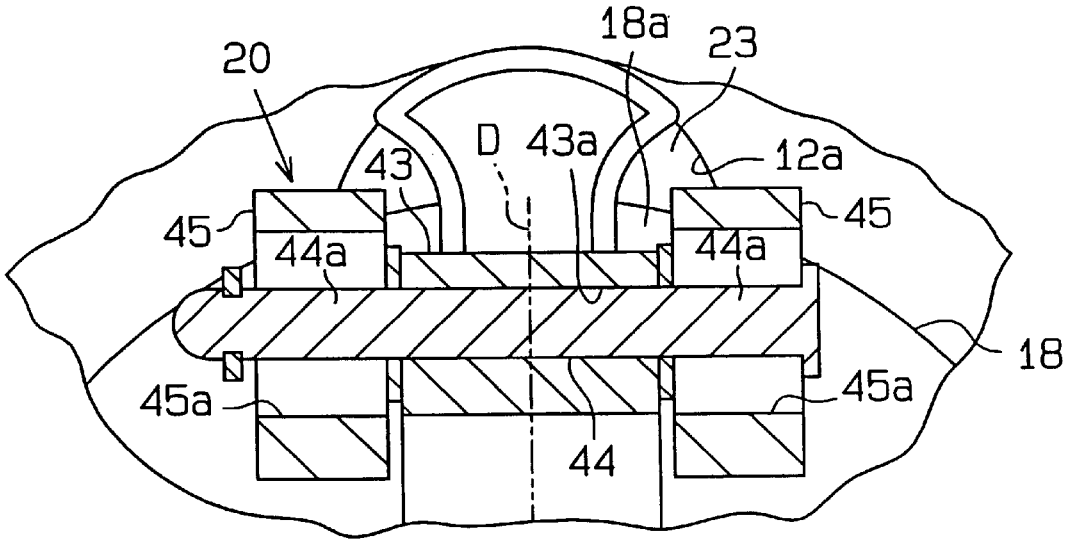
FIG. 4 is a cross sectional view taken along line 4—4 in FIG. 2.

Details of the hinge mechanism 20 will now be described with reference to FIGS. 2 and 4. As shown in FIG. 2, a swing arm 43, which functions as a first hinge part, extends from the front face of the swash plate 18 toward the rotor 17. The swash plate 18 has a top dead center positioning section 18*a* for positioning a corresponding piston at its top dead center position. The longitudinal axis of the swing arm 43 lies in a plane D (FIG. 4), which extends from a center of the top dead center positioning section 18*a* of the swash plate 18 and includes the axis L of the drive shaft 16. As shown in FIG. 4, a mounting hole 43*a* extends through the distal end of the swing arm 43 in a direction perpendicular to the plane D. A guide pin 44, which is made of iron-based metal, is press fitted into the mounting hole 43*a*. The ends 44*a* of the guide pin 44 respectively extend outwardly from the sides of the swing arm 43.

Figure 2:
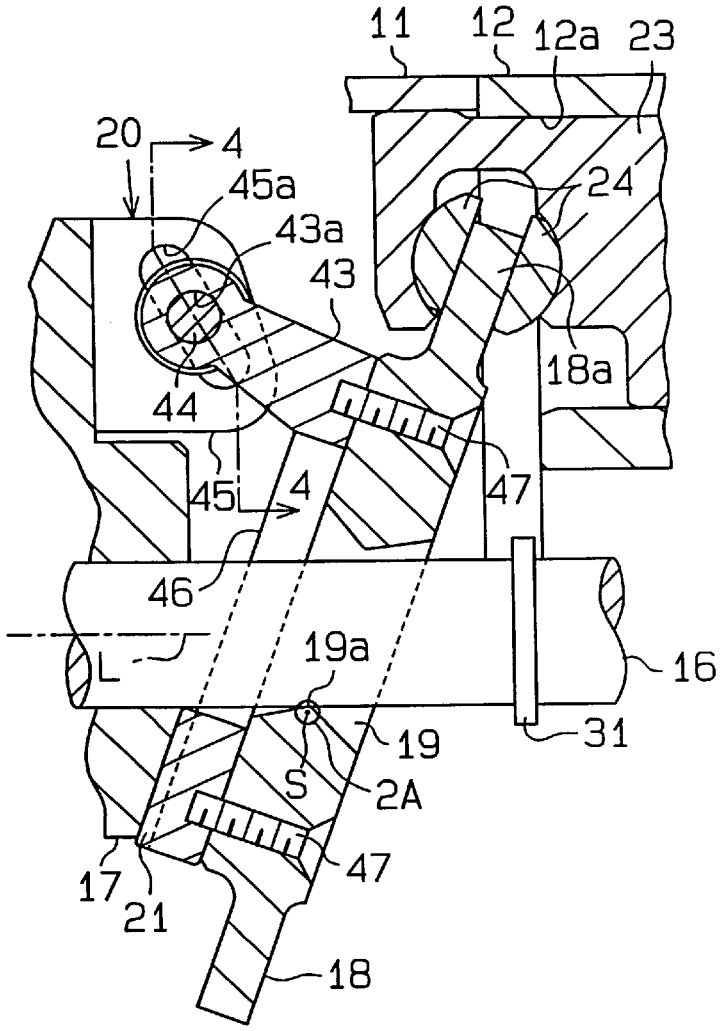
FIG. 2 is an enlarged longitudinal cross sectional view of a hinge mechanism of the variable displacement compressor of FIG. 1, showing the swash plate tilted to its maximum inclination.
Figure 2A:
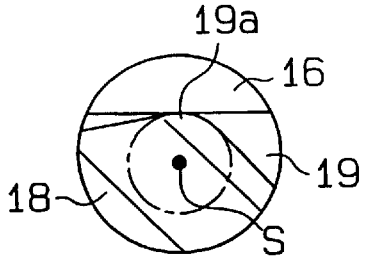
FIG. 2A is an enlarged view of the portion of FIG. 2 that is encompassed by the circle 2A.

As shown in FIGS. 2 and 4, a pair of support arms 45 extends from the rear face of the rotor 17 toward the swash plate 18. The support arms 45 are symmetrically arranged with respect to the plane D and function as a second hinge part. The swing arm 43 is held between the support arms 45. As shown in FIG. 2, each support arm 45 has an oblong guide hole 45*a* that extends obliquely toward the drive shaft 16. The ends 44*a* (FIG. 4) of the guide pin 44 are received in the corresponding guide holes 45*a* of the support arms 45.

A counter-weight 21 is attached to the front face of the swash plate 18 on a side that is opposite to the swing arm 43 with respect to the axis L, of the drive shaft 16.

As shown in FIG. 1, cylinder bores 12*a* (only one of the cylinder bores 12*a* is shown in FIG. 1) are formed in the cylinder block 12 to extend parallel to the axis L of the drive shaft 16. The cylinder bores 12*a* are arranged at equal angular intervals about the axis L of the drive shaft 16. A single-headed piston 23 is received in each cylinder bore 12*a*. Each piston 23 engages a peripheral region of the swash plate 18 via a pair of semispherical shoes 24.

A suction chamber 25 is centrally defined in the rear housing 13. A discharge chamber 26 is defined adjacent to the outer circumference of the rear housing 13. A suction port 27, a suction valve flap 28, a discharge port 29 and a discharge valve flap 30 are formed in the valve plate 14 for each cylinder bore 12*a*.

As described above, the swash plate 18 rotates integrally with the drive shaft 16 through the rotor 17 and the hinge mechanism 20. The rotation of the swash plate 18 is converted to reciprocation of each piston 23 in its cylinder bore 12*a* through the shoes 24. FIG. 1 shows one of the pistons 23 at its top dead center position. When the swash plate 18 is rotated 180 degrees from this position about the axis L of the drive shaft 16, the piston 23 shown in FIG. 1 will be positioned at its bottom dead center position.

During the back stroke of the piston 23, from top dead center to bottom dead center, the refrigerant gas in the suction chamber 25 is drawn through the suction port 27 and the suction valve flap 28 into the cylinder bore 12*a*. During forward stroke of the piston 23, from bottom dead center to top dead center, the refrigerant gas in the cylinder bore 12*a* is compressed and is discharged through the discharge port 29 and the discharge valve flap 30 into the discharge chamber 26.

Figure 3:
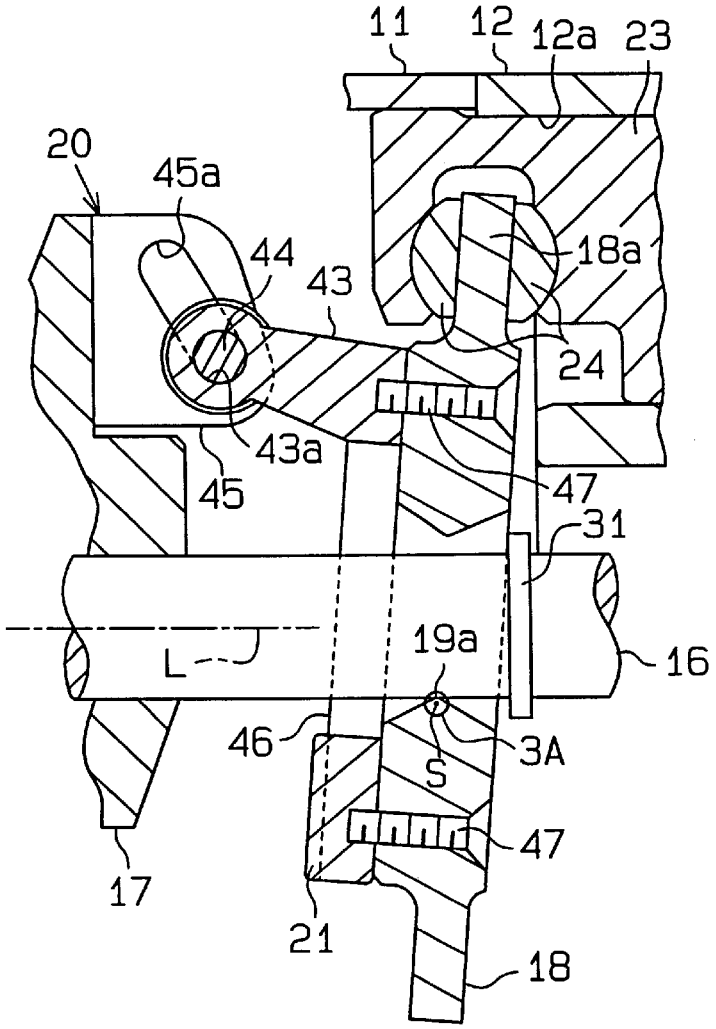
FIG. 3 is an enlarged longitudinal cross sectional view like FIG. 2, showing the swash plate tilted to its minimum inclination.
Figure 3A:
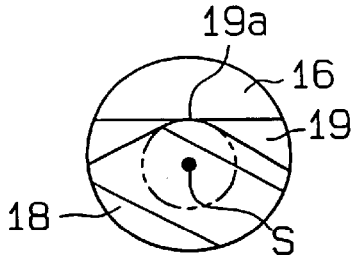
FIG. 3A is an enlarged view of the portion of FIG. 3 that is encompassed by the circle 3A.

When the swash plate 18 tilts relative to the drive shaft 16 and slides in an axial direction L of the drive shaft 16, the ends 44*a* of the guide pin 44 move in the guide holes 45*a* of the support arms 45, and the swash plate 18 slides along the drive shaft 16. As the swash plate 18 moves away from the rotor 17, the angle of the swash plate 18 relative to a plane perpendicular to the axis L of the drive shaft 16 is reduced, that is, the inclination of the swash plate 18 is reduced. When the swash plate 18 engages a snap ring 31 that is fixed to the drive shaft 16, the swash plate 18 has reached its minimum inclination position (FIG. 3). On the other hand, as the swash plate 18 moves toward the rotor 17, the inclination of the swash plate 18 is increased. When the counter-weight 21 engages the rotor 17, the maximum inclination of the swash plate 18 is reached (FIG. 2).

As shown in FIG. 1, a gas relieving passage 35 is defined in the center of the valve plate 14 for connecting the crank chamber 15 with the suction chamber 25. The rear end of the drive shaft 16 is supported by a bearing in a support hole 12*b* that is formed in the center of the cylinder block 12. The refrigerant gas in the crank chamber 15 flows through gaps in the bearing and through the gas relieving passage 35 into the suction chamber 25. A supply passage 36 extends through the rear housing 13, the valve plate 14 and the cylinder block 12 to connect the discharge chamber 26 with the crank chamber 15.

A displacement control valve 37 is provided in the supply passage 36 within the rear housing 13. A pressure introduction passage 38 is formed in the rear housing 13 to introduce the pressure (suction pressure) of the suction chamber 25 to the displacement control valve 37. The displacement control valve 37 includes a valve body 37*b*, which regulates the size of the opening area of the supply passage 36, and a diaphragm 37*a*, which moves the valve body 37*b* in accordance with the suction pressure, which is applied to the diaphragm 37a through the pressure introduction passage 38.

When the size of the opening area of the supply passage 36 is changed by the valve body 37*b*, the amount of refrigerant gas that is supplied from the discharge chamber 26 to the crank chamber 15 through the supply passage 36 is changed. This will cause the pressure of the crank chamber 15 to be changed, and, therefore, the pressure difference between the crank chamber 15 and the cylinder bore 12*a* is changed. This pressure difference determines the inclination of the swash plate 18. As the inclination of the swash plate 18 is changed, the stroke of the pistons 23, or the displacement of the compressor, is changed.

For example, when the cooling load is increased, the suction pressure is increased. This will exert a higher pressure on the diaphragm 37*a* to reduce the opening area of the supply passage 36 with the valve body 37*b*. As a result, the amount of refrigerant gas that is supplied from the discharge chamber 26 to the crank chamber 15 through the supply passage 36 is accordingly reduced. Since more refrigerant gas is leaving the crank chamber 15 through the gas relieving passage 35 than is entering through the supply passage 36, the pressure of the refrigerant gas in the crank chamber 15 falls. As a result, the inclination of the swash plate 18 is increased. Therefore, the stroke of the pistons 23 is increased to increase the displacement of the compressor, and the suction pressure is reduced accordingly.

When the cooling load is reduced, the suction pressure in the suction chamber 25 is reduced. This will reduce the pressure on the upper side of the diaphragm 37*a*, which increases the opening area of the supply passage 36 with the valve body 37*b*. As a result, the amount of the refrigerant gas that is supplied from the discharge chamber 26 to the crank chamber 15 through the supply passage 36 is increased, causing the pressure of the crank chamber 15 to increase. As a result, the inclination of the swash plate 18 is reduced. Therefore, the stroke of the pistons 23 is reduced to reduce the displacement of the compressor, so the suction pressure is accordingly increased.

The swash plate 18 is made of aluminum or aluminum alloy material. The aluminum alloy material of the present invention includes hard particles that are made of eutectic silicon or hyper-eutectic silicon. A hard particle content is preferably more than 12 wt % (weight percentage) of the aluminum alloy material. If the hard particle content is less than 12 wt %, satisfactory wear resistance cannot be achieved at the engaging surfaces of the swash plate 18, such as the peripheral surface that engages the shoes 24, and the engaging section 19*a* that engages the drive shaft 16.

The average diameter of the hard particles is preferably in a range of 10 to 60 $\mu$m, more preferably in a range of 30 to 40 $\mu$m and most preferably in a range of 34 to 37 $\mu$m. If the average diameter of the hard particles is less than 10 $\mu$m or greater than 60 $\mu$m, the satisfactory wear resistance cannot be achieved at the engaging surfaces of the swash plate 18.

The swing arm 43 is separate from the swash plate 18 and is made of the iron-based metal material. The swing arm 43 and the counter-weight 21 are integrally formed on a base ring 46. The base ring 46 is fixed to the front face of the swash plate 18 by bolts 47 around the drive shaft 16. The shape of the base ring 46 is suitable for integrating the swing arm 43 and the counter-weight 21 and for attaching the swing arm 43 and the counter-weight 21 to the swash plate 18 without interfering with the rotation of the drive shaft 16.

In general, the counter-weight 21 is provided to maintain the rotational balance of the swash plate. However, in the present embodiment, the mass and the position of the counter-weight 21 are selected to move the center of gravity of the swash plate toward the swing arm 43. Therefore, during rotation of the swash plate 18, the centrifugal force that is exerted on the swash plate 18 assures engagement between the engaging section 19*a* of the through-hole 19 and the drive shaft 16.

The present embodiment provides the following advantages.

The swash plate 18 is made of aluminum-based material that is lighter than iron-based metal material, so the weight of the compressor is reduced. The swing arm 43 is separate from the swash plate 18 and is made of iron-based metal material, which has more strength than aluminum-based material. Therefore, the strength and durability of the swing arm 43, which is subjected to large stresses, are improved.

The iron-based metal swing arm 43 is stronger and more rigid than swing arms that are made of aluminum-based material. Therefore, the guide pin 44 can be press fitted into the mounting hole 43*a* of the swing arm 43 while assuring satisfactory strength in the connection between the guide pin 44 and the swing arm 43.

The swash plate 18 is directly supported by the drive shaft 16. Therefore, the construction of the present invention is simpler than constructions using a sleeve that is slidably supported on the drive shaft and pivotally connected to the swash plate.

The swash plate 18 is made of aluminum alloy that includes silicon hard particles, so the swash plate 18 resists wear. Therefore, even though the swash plate 18 is directly supported by the drive shaft 16, problems that are associated with wear of the swash plate 18 are prevented.

The swing arm 43 is attached to the swash plate 18 by the bolt 47. Therefore, the attachment of the swing arm 43 to the swash plate 18 is relatively simple.

The swing arm 43 is arranged between the support arms 45. Therefore, whether the drive shaft 16 is constructed to rotate clockwise or counterclockwise, the rotational torque of the rotor 17 is always transmitted to the swing arm 43 by the support arm 45 that is located on a trailing side of the swing arm 43. Therefore, the compressor according to the present embodiment can rotate clockwise and/or counterclockwise. As a result, one type of compressor can rotate clockwise or counterclockwise, which is more efficient than manufacturing two types of compressors, i.e., compressors that can only rotate clockwise and compressors that can only rotate counterclockwise, to meet customer's needs. This reduces the compressor manufacturing cost.

The swing arm 43 and the counter-weight 21 are integrally formed with the base ring 46. Therefore, the number of the parts is reduced, and the manufacturing process is simplified.

The counter-weight 21 defines the maximum inclination of the swash plate 18 by engaging the rotor 17. The iron-based metal counter-weight 21 has superior strength and wear resistance in comparison to an aluminum alloy counter-weight. As a result, deformation and wear of the counter-weight 21 due to engagement with the rotor 17 is impeded, so the swash plate 18 is correctly positioned at a predetermined maximum inclination.

The present invention is not limited to the illustrated embodiment. The illustrated embodiment can be modified as follows.

Figure 5:
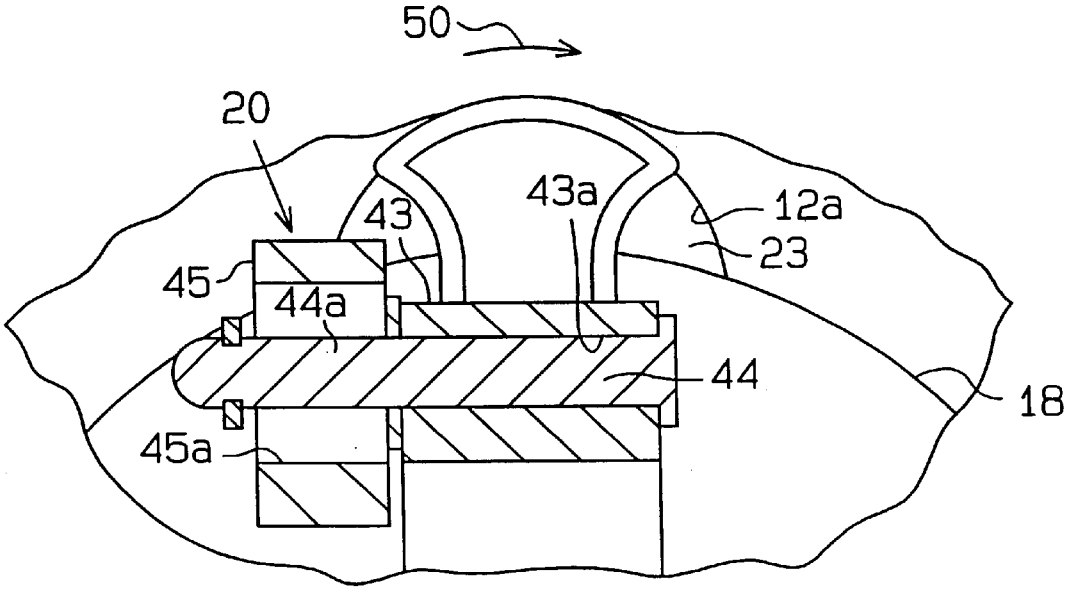
FIG. 5 is a cross sectional view like FIG. 4 of a hinge mechanism according to a second embodiment of the present invention.

As shown in FIG. 5, a second embodiment of the present invention includes a hinge mechanism 20 that is employed in compressors that rotate in only one direction (indicated with an arrow 50). The hinge mechanism 20 includes only one support arm 45. The support arm 45 is arranged on a trailing side of the swing arm 43.

Unlike the first and second embodiments of FIGS. 1 and 5, the guide pin can be fixed to the support arm 45, and the guide hole for receiving the guide pin can be formed in the swing arm 43.

Figure 6:
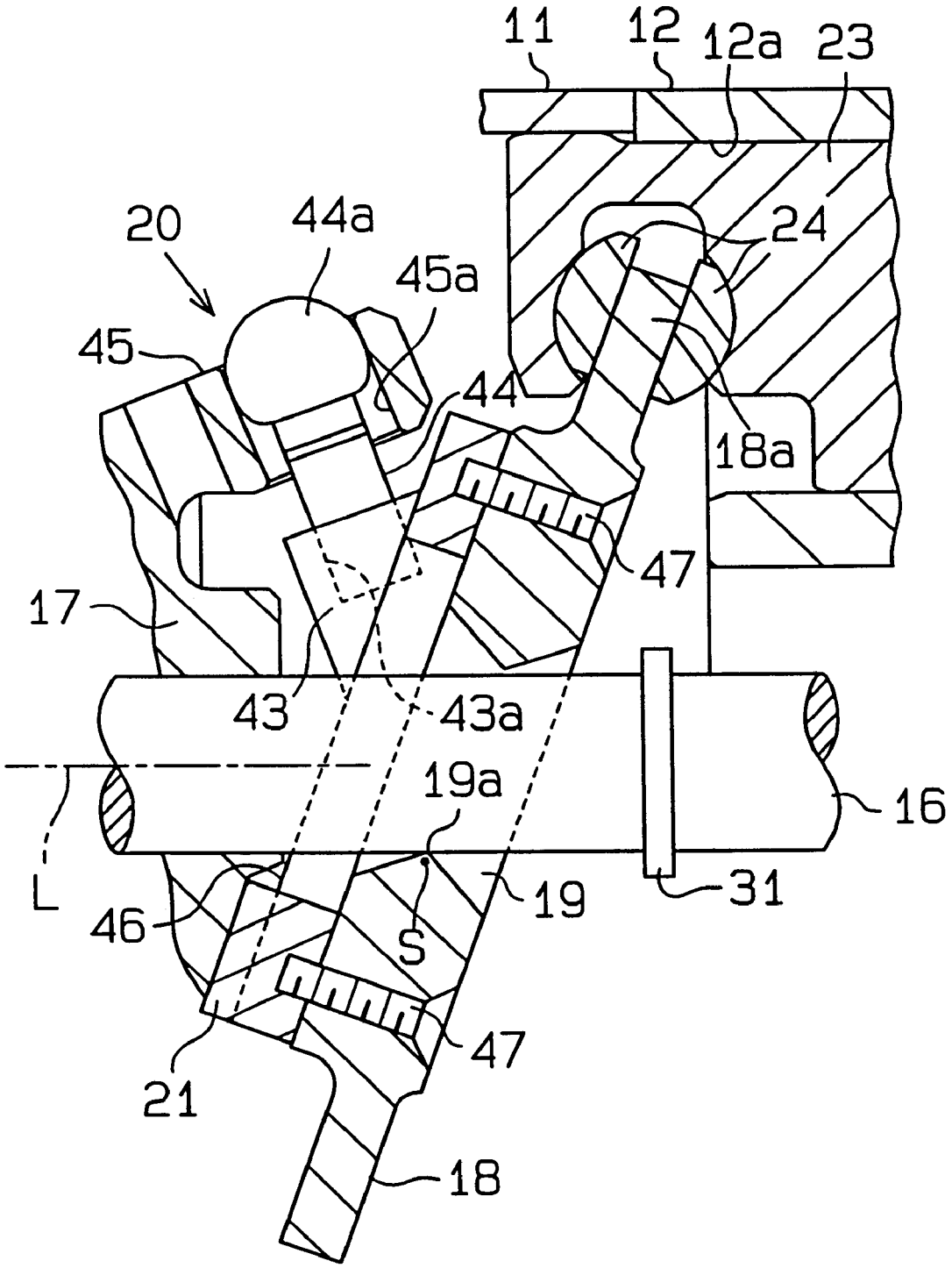
FIG. 6 is a cross sectional view like FIG. 2 according to a third embodiment of the present invention.

As shown in FIG. 6, a hinge mechanism 20 of a third embodiment is different from the hinge mechanism 20 of the first embodiment (FIG. 1). In FIG. 6, the same numerals are used to identify parts corresponding to those of FIG. 1.

In the hinge mechanism 20 of FIG. 6, the support member 43, which functions as the first hinge part, is integrally formed with the counter-weight 21 on the support ring 46. The support member 43 and the counter-weight 21 are fixed to the swash plate 18 with the bolts 47. The support member 43 is made of the same material as that of the swing arm 43 of the hinge mechanism 20 of FIG. 1. That is, the support member 43 is made of iron-based metal material. One iron-based metal guide pin 44 is press fitted into a mounting hole 43*a*, which is formed in the support member 43. The distal end 44*a* of the guide pin 44 is spherical. The support arm 45 extends from the rear face of the rotor 17 toward the swash plate 18. The support arm 45 includes a guide hole 45*a* for receiving the spherical distal end 44*a* of the guide pin 44. The hinge mechanism 20 of FIG. 6 provides the same advantages as the hinge mechanism 20 of FIG. 1. There may be two guide pins 44 and two corresponding guide holes 45*a* in the support arm 45.

The base ring 46 can be fixed to the swash plate 18 by friction welding. In so doing, the base ring 46 can be fixed to the swash plate 18 without requiring any fasteners, so the number of parts is reduced. In friction welding, the base ring 46 and the swash plate 18 are brought together under load. Then, the base ring 46 is rotated with respect to the swash plate 18. This rotation causes frictional heat to weld the base ring 46 and the swash plate 18 together.

The base ring 46 can also be fixed to the swash plate 18 by other types of welding.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing defining a cylinder bore;

a piston located in the cylinder bore;

a drive shaft rotatably supported by the housing;

a rotor mounted on the drive shaft to rotate integrally with the drive shaft;

a drive plate having at least a portion of aluminum or aluminum alloy material, wherein the drive plate is connected to the piston to convert rotation of the drive shaft to reciprocation of the piston and the aluminum or aluminum alloy portion of the drive plate is connected to the drive shaft such that the drive plate inclines and slides axially along the drive shaft, varying the piston stroke to change the displacement of the compressor; and a hinge mechanism located between the rotor and the drive plate for rotating the drive plate integrally with the rotor and for guiding the motion of the drive plate, the hinge mechanism comprising a first hinge part made of iron-based metal material, the first hinge part being connected to the aluminum or aluminum alloy portion of the drive plate, and a second hinge part extending from the rotor, wherein the first and second hinge parts are coupled to one another to permit both pivoting and sliding motion between the first and second hinge parts.

2. A compressor according to claim 1, wherein the first hinge part includes a mounting hole, a pin is pressed fitted into the mounting hole, and one end of the pin extends from the first hinge part and is received in a guide opening of the second hinge part.

3. A compressor according to claim 1, wherein the second hinge part includes a pair of support arms, and the first hinge part is held between the support arms.

4. A compressor according to claim 3, wherein the first hinge part includes a mounting hole, a pin is pressed fitted into the mounting hole, and the ends of the pin extend from the first hinge part and are received by the support arms.

5. A compressor according to claim 1, wherein hard particles of silicon are embedded in the drive plate.

6. A compressor according to claim 5, wherein a content of the hard particles is more than 12 wt % by weight of the material of the drive plate.

7. A compressor according to claim 5, wherein an average diameter of the hard particles is in a range of 10 to 60 $\mu$m.

8. A compressor according to claim 1, wherein the first hinge part is fixed to the drive plate with a bolt.

9. A compressor according to claim 1, wherein the first hinge part is fixed to the drive plate by friction welding.

10. A compressor according to claim 1, wherein the aluminum or aluminum alloy portion of the drive plate includes a through-hole for receiving the drive shaft, the through-hole comprising an engaging section which is part of a wall defining the through-hole, and the engaging section always engages the drive shaft during rotation of the drive plate.

11. A compressor according to claim 1, further comprising a counter-weight for adjusting the balance of the drive plate, the counter-weight being attached to the drive plate on a side of the drive plate that is opposite to the first hinge part with respect to the axis of the drive shaft, wherein the counter-weight is integrally formed with the first hinge part.

12. A compressor according to claim 11, wherein the counter-weight engages the rotor when the drive plate reaches its maximum inclination.

13. A variable displacement compressor comprising:

a housing defining a cylinder bore;

a piston located in the cylinder bore;

a drive shaft rotatably supported by the housing;

a rotor mounted on the drive shaft to rotate integrally with the drive shaft;

a swash plate of an aluminum alloy material, the swash plate being connected to the piston to convert rotation of the drive shaft to reciprocation of the piston, wherein the swash plate is supported on the drive shaft, the swash plate includes a through-hole defined by a wall of the alluminum alloy material that includes an engaging section, the engaging section always engaging the drive shaft during rotation of the swash plate, and the swash plate inclines and slides axially along the drive shaft to vary the piston stroke and change the displacement of the compressor; and a hinge mechanism located between the rotor and the swash plate for rotating the swash plate integrally with the rotor and for guiding the motion of the swash plate, the hinge mechanism comprising a first hinge part connected to the aluminum alloy material of the swash plate, a second hinge part extending from the rotor, and a pin attached to the first hinge part and having an end extending from the first hinge part to the second hinge part, wherein the first hinge part is made of an iron-based metal material and includes a mounting hole in which the pin is press fitted, and the second hinge part includes a guide hole for receiving the end of the pin to guide movement of the first hinge part relative to the second hinge part.

14. A compressor according to claim 13, wherein the second hinge part includes two support arms between which the first hinge part is held, and the pin extends from the first hinge part to each support arm.

15. A compressor according to claim 13, further comprising hard particles of silicon embedded in the swash plate.

16. A compressor according to claim 15, wherein a content of the hard particles is more than 12 wt %.

17. A compressor according to claim 15, wherein an average diameter of the hard particles is in a range of 10 to 60 $\mu$m.

18. A compressor according to claim 13, wherein the first hinge part is fixed to the swash plate with a bolt.

19. A compressor according to claim 13, wherein the compressor further comprises a counter-weight for adjusting the balance of the swash plate, wherein the counter-weight is attached to the swash plate on a side of the swash plate that is opposite to the first hinge part with respect to the axis of the drive shaft, and wherein the counter-weight is integrally formed with the first hinge part.

20. A compressor according to claim 19, wherein the counter-weight engages the rotor when the swash plate reaches its maximum inclination.

* * * * *